United States Patent [19]

Berfield

[11] Patent Number: 4,592,111

[45] Date of Patent: Jun. 3, 1986

[54] SPRING RETAINER FOR VACUUM CLEANER NOZZLE BRUSH

[75] Inventor: Robert C. Berfield, Jersey Shore, Pa.

[73] Assignee: Shop-Vac Corporation, Williamsport, Pa.

[21] Appl. No.: 704,944

[22] Filed: Feb. 25, 1985

[51] Int. Cl.[4] ..... A47L 9/06

[52] U.S. Cl. ..... 15/371; 15/398

[58] Field of Search ..... 15/365, 367, 371, 373, 15/398

[56] References Cited

U.S. PATENT DOCUMENTS

| | | | |
|---|---|---|---|
| 2,086,124 | 7/1937 | Ell | 15/371 X |
| 2,128,525 | 8/1938 | Dyer | 15/371 X |
| 2,616,118 | 11/1952 | Meyerhoefer | 15/371 X |
| 3,797,066 | 3/1974 | Zaidan | 15/371 X |
| 3,832,753 | 9/1974 | Crooks | 15/371 |

FOREIGN PATENT DOCUMENTS

| | | | |
|---|---|---|---|
| 168700 | 8/1934 | Switzerland | 15/365 |

*Primary Examiner*—Chris K. Moore

*Attorney, Agent, or Firm*—Ostrolenk, Faber, Gerb & Soffen

[57] ABSTRACT

A nozzle for a vacuum suction cleaner has a suction inlet on its bottom surface, and behind the inlet, the nozzle has a brush receiving chamber. The brush comprises a support bar in the brush chamber and the support bar supports depending bristles. A respective spring at both lateral ends of the brush chamber presses against the bristle support bar and urges the brush out of the housing. A respective spring supporting retainer which is integral with each spring is clipped to each of two projections at the lateral ends of the brush chamber and that spring supporting retainer is removable from its projection to facilitate removal of the brush from the brush chamber.

15 Claims, 7 Drawing Figures

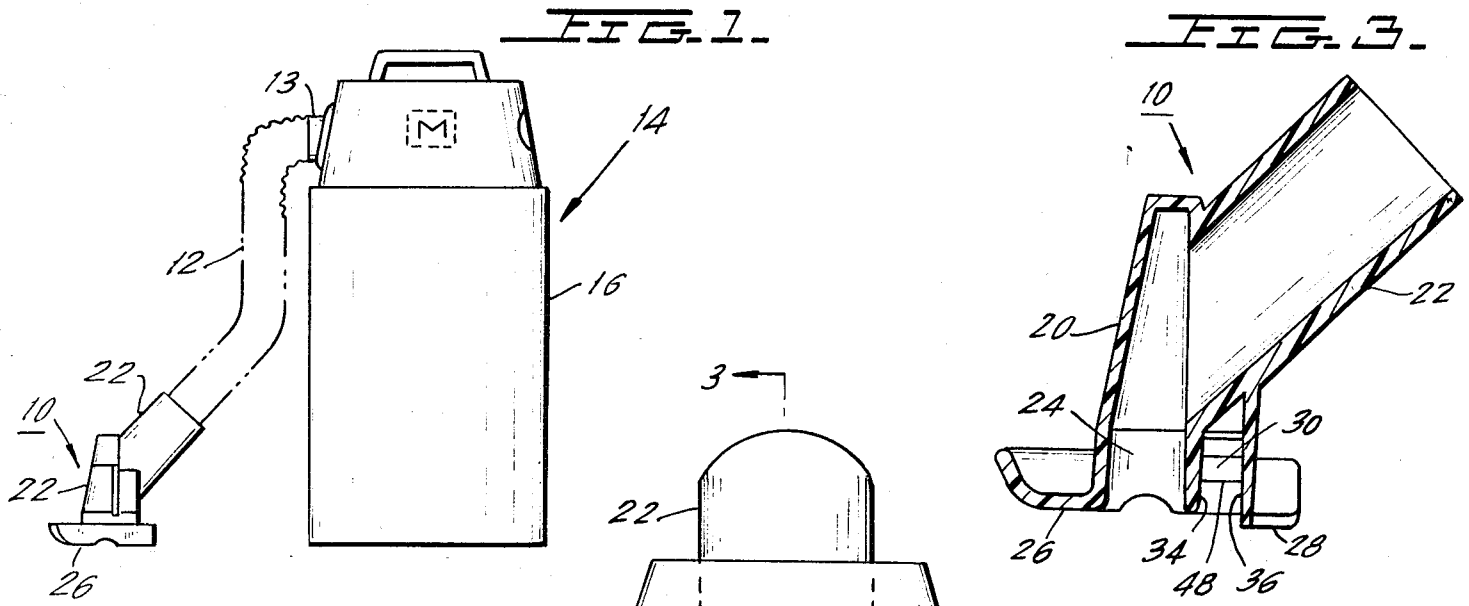
FIG. 3.
FIG. 1.
10
12
13
14
16
20
22
24
26
28
30
34
36
48
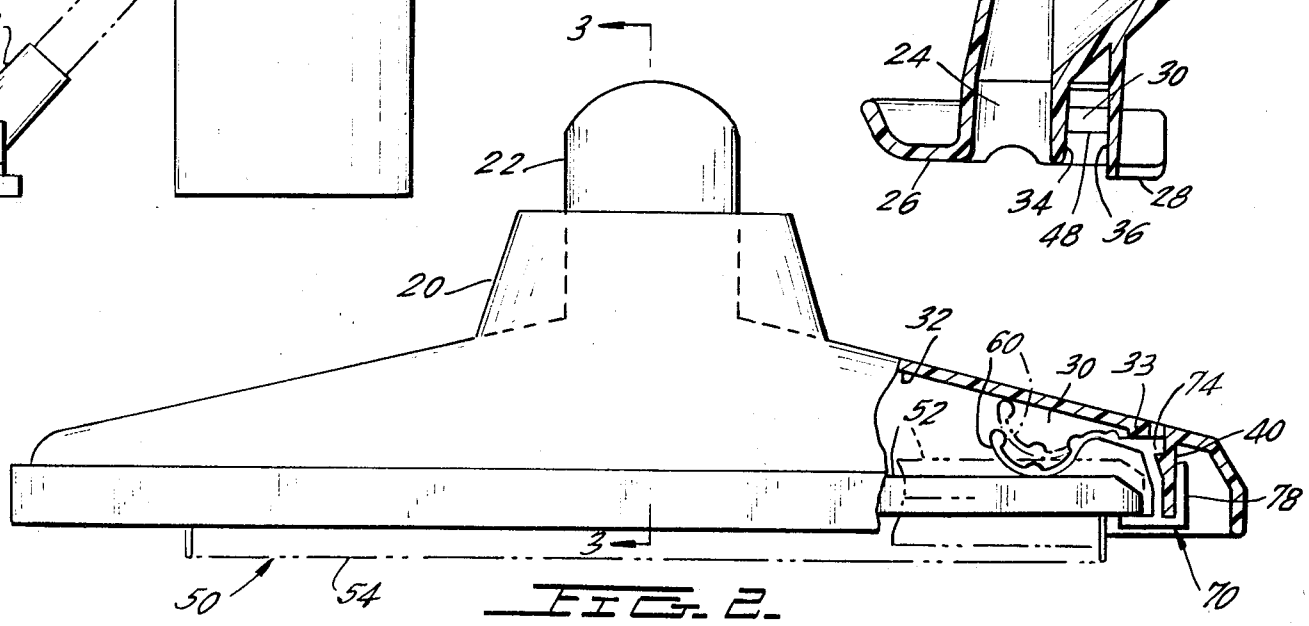
FIG. 2.
3
20
22
30
32
33
40
50
52
54
60
70
74
78

SPRING RETAINER FOR VACUUM CLEANER NOZZLE BRUSH

BACKGROUND OF THE INVENTION

The present invention relates to the nozzle on the hose of a vacuum cleaner, and particularly to the brush on that nozzle and more particularly to a spring retainer for that brush.

Vacuum cleaners typically have an intake suction hose to which a nozzle is attached. The nozzle includes a housing with an intake or suction inlet opening at its bottom side. A brush may be supported in the nozzle housing to the rear of the inlet and the brush moves dirt to the inlet passageway. A brush having bristles which project out of the bottom of the nozzle housing to an extent adequate for brushing a flat floor may project out too far when the same nozzle is moved over a carpet, and bristles that are the correct length for a carpet may be too short to brush a floor. In practice, the original nozzle may be replaced when the texture of the surface changes significantly, or a floor brush may be removed to permit use of the same nozzle on a carpeted surface. It is also known to retract a brush in a nozzle by various retraction mechanisms. The retraction mechanisms often include various complicated linkages, swivels for the brush, etc.

It is also known to mold brushes for vacuum cleaner nozzles from plastic material, wherein the brush bristles are integrally molded on a support and the support is held in the vacuum cleaner housing. It is desirable for the brush to be able to "float" in the housing, so that the degree of extension of the bristles will automatically adjust depending upon the nature of the surface over which the nozzle is moved. Various spring arrangements for the brush of the nozzle of an electric vacuum cleaner are known. See, for example, U.S. Pat. Nos. 3,329,989 and 2,570,759. Again, known spring arrangements are typically complex and the nozzle includes an excessive number of parts.

SUMMARY OF THE INVENTION

Accordingly, it is the primary object of the present invention to provide a nozzle for the hose of a vacuum cleaner with an improved retraction mechanism for the brush of the nozzle assembly.

It is another object of the present invention to make the brush and retraction mechanism simple and with a minimum number of parts.

It is another object of the present invention to provide an improved spring arrangement for urging the brush bristles out of the vacuum cleaner.

Yet another object of the present invention is to facilitate the removal of the brush, the spring mechanism for urging the brush out of the vacuum cleaner and the retainer for the brush and to ease the installation of the brush, the spring and the retainer for the brush in the vacuum cleaner.

The nozzle for the vacuum cleaner according to the present invention includes a nozzle housing. The nozzle housing has a bottom side which moves over the surface, such as a floor or carpeting, to be vacuum cleaned. The nozzle bottom side has an intake opening which is wide from side to side and narrow front to back. To the rear of the intake opening is disposed a brush for brushing dirt into the intake opening as the nozzle is moved forward. To the rear of the intake opening, the nozzle housing includes walls that define a cavity for containing the brush. The cavity has a front and a rear wall and the brush includes a bristle support bar that has a front to back width that corresponds to the spacing between the cavity front and rear walls which prevents rocking of the brush forward and rearwardly as the nozzle is moved back and forth. The support bar for the bristles is of a height that is short enough to provide a clearance space above the support bar in the housing for a spring for the brush.

Toward each lateral end of the brush cavity, the upper wall of the housing in the cavity has a respective brush carrier, which is a depending projection for the retainer portion of the brush supporting spring and spring retainer unit, described below.

Each spring and its retainer are preferably a single integrally molded piece of plastic material which resists corrosion in the presence of the material being suctioned, and particularly liquid or wet particulate materials. The combined spring and retainer includes a spring which is normally biased to urge the brush out of the brush cavity. The spring is integrally attached on a retainer which is in the form of a clip, and the retainer clip is clipped to the projection in the housing. Each retainer clip includes a shelf on which the respective end of the brush support bar rests, and the retainer clip shelf prevents the brush from being urged out of the brush cavity by the biasing force of the spring. When the bristles press against a floor or carpet, this pushes the bristle support bar up off the retainer clip shelves into the cavity, against the bias of the spring in the cavity which urges the support bar back toward the shelves.

The clip is held to the projection in the brush cavity by friction and also by detent means, and the detent means are adapted to be manipulated to free the clip from the projection. Removal of the clip from the projection frees the spring and frees the support bar of the brush so that the brush can be removed from the housing and be replaced. When a brush is to be placed in the brush cavity, it is simply assembled on the shelves of the retaining clips and then the clips are installed on their projections. The springs inside the cavity again bias the support bar of the brush outwardly while the retainer clip holds the brush assembly in the cavity.

The foregoing and other objects and features of the present invention will become apparent from the following description of a preferred embodiment of the invention considered in conjunction with the accompanying drawings.

BRIEF DESCRIPTION OF THE DRAWINGS

FIG. 1 is a view of an electric vacuum cleaner in which the invention is incorporated;

FIG. 2 is a front view of a nozzle provided with the invention and partially broken away;

FIG. 3 is a side cross-sectional view of the nozzle along the line of arrows 3;

DETAILED DESCRIPTION OF THE INVENTION

Figure 7:
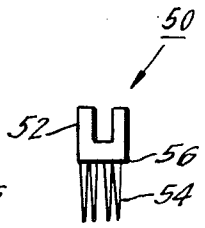
FIG. 7 is an end view of the brush.
Figure 6:
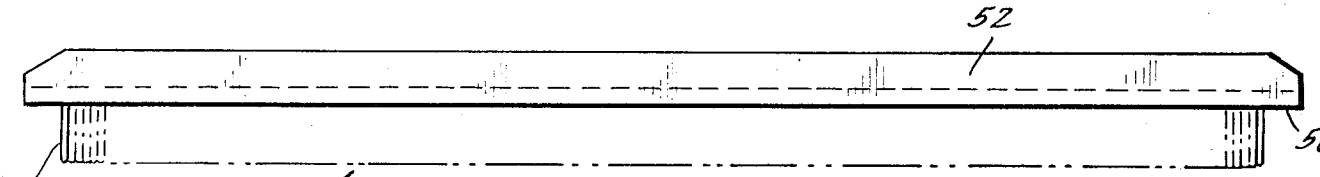
FIG. 6 is a front view of the brush for use in the nozzle.
Figure 4:
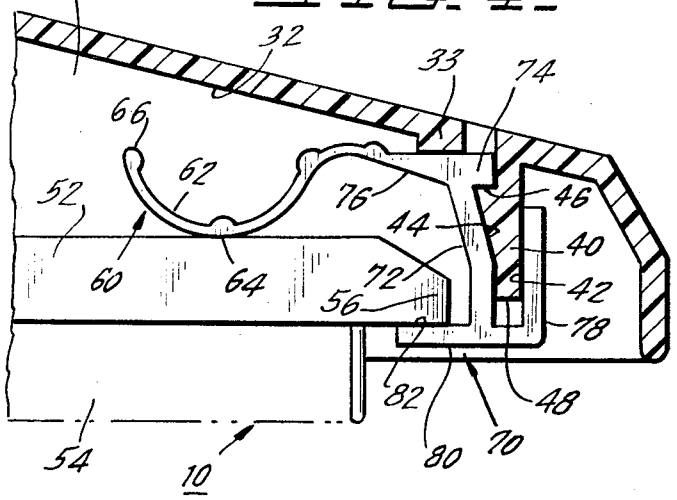
FIG. 4 is an enlarged fragmentary view of the nozzle showing the spring and the retainer for the spring.
Figure 5:
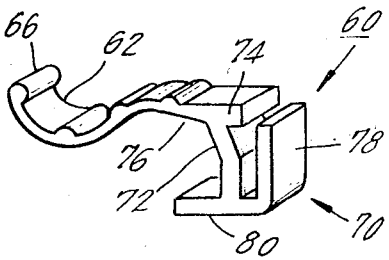
FIG. 5 is a perspective view of the combined spring and retainer.

Referring to FIG. 1, a vacuum cleaner nozzle 10 is provided with a brush 50 that is held by the spring and retainer 60 according to the present invention. The nozzle is attached to a hose 12 which is in turn attached to the air inlet 13 to a conventional cannister type electric vacuum cleaner 14. The vacuum cleaner has a material collecting tank 16 and an air outlet, as is conventional.

The nozzle 10 comprises a housing 20 with an outlet fitting 22 that is connected to the hose 12. As is conventional, the housing 20 is narrow front to back and is quite wide from side to side, as can be seen in FIGS. 2 and 3. The outlet fitting 22 communicates into a suction inlet 24 of the housing which opens beneath the housing 20. The suction inlet is wide between the lateral sides of the housing and short from front to back. To the front of the inlet opening 24, there is a front, ground riding surface 26. At the rear of the housing there is a rear, ground riding surface 28. The surfaces 26 and 28 orient the inlet opening for suction.

It is conventional to dispose a brush to the rear of a nozzle inlet so that as the vacuum cleaner is moved forward, the bristles of the brush push dirt toward the inlet. The molded housing 20 has a cavity 30 molded into it to the rear of the inlet opening 24 for receiving the brush, as described below. The cavity 30 is open at the bottom. The upper wall 32 of the housing at the cavity 30 defines the upper wall of the brush cavity. The height of the upper wall 32 is great enough with respect to the height of the brush 50 that there is sufficient space for the brush to shift into the cavity as the brush is moved over different surfaces, as described further below. The upper wall 32 in the brush cavity further includes a short molded projection 33 which extends to engage the retainer 70, as described below. The nozzle housing 20 includes a cavity defining front wall 34 and rear wall 36 which are spaced apart the front to back width of the brush support bar 52, described below, which prevents the brush 50 from shifting forwardly and rearwardly in the housing 20 as the nozzle is moved back and forth in normal use.

Toward the opposite lateral ends of the cavity 30, respective brush carriers in the form of spring retaining projections 40 are molded to and project down from the top wall 32. The projection 40 has a flat laterally outwardly facing surface 42 over which the leg 78 of the spring retainer 70 can slide as the brush 50 moves into and out of the housing. The inwardly facing side 44 of the projection 40 includes a short shelf 46 defined on it which helps retain the spring in the cavity 30, as further described below. The bottom end 48 of the projection 40 does not extend down to the bottom of the housing 20, and thereby leaves sufficient space in the cavity beneath the bottom 48 of the projection for the brush retainer to be inside the housing.

The brush 50 comprises a rigid supporting bar 52 of molded plastic from the bottom of which project a plurality of integrally molded bristles 54. The bristles 54 are flexible enough to brush dirt toward the housing suction inlet 24 and are stiff enough that as pressure is applied to the bristles from below, the bristles transmit the force to the bar 52 and shift it into the cavity 30 and against the bias of the spring 62. The bar 52 is of relatively short height, providing a large clearance space in the cavity 30 above the bar 52 for the spring 62. The bar 52 includes end portions 56 beyond the ends of the rows of bristles. The end portions 56 are engaged by shelves 80 on the retainer clips 70, described below.

At each lateral end of the housing 20 a respective combined spring and retainer 60 is provided. The spring and retainer 60 is a single integral piece, preferably of molded plastic so that it will not corrode in the presence of suctioned liquid or wet particulate materials. The spring 62 of the combined spring and retainer 60 is illustrated as "S" shaped, but it may be "U"-shaped. It includes a curved spring portion 64 which is normally biased against the top of the bar 52. It includes an end portion 66, which is shown as curved, but may end short of the curvature, and which is movable up into contact with the top wall 32 of the cavity 30. The spring is so shaped and is sufficiently resilient to normally bias the bar 52 and thereby the brush 50 out of the cavity 30.

The brush and retainer 60 integrally includes a retainer clip 70 which has a guide leg 72 that extends down the inwardly facing side 44 of the projection 40. The projection 74 at the top of the leg 72 rests atop the shelf 46 and retains the clip in the cavity 30.

The retainer 70 includes a shelf 76 which rests against the bottom of the projection 33 and helps orient the retainer.

At the opposite side of the projection 40 from the leg 72 is the leg 78 of the retainer clip 70, and the leg 78 is straight to mate with the straight, outward wall 42 of the projection 40. The legs 78 and 72 of the retainer clip 70 are spaced apart approximately the width of the projection 40, and this maintains the proper orientation for the spring 62 even as the bar 52 shifts.

The bottom ends of the legs 72 and 78 are joined by the brush support shelf 80 which is rigidly connected to the legs 72, 78 and also extends beneath the undersides 82 of the end portions 56 of the bar 52. As the spring 62 biases the bar 52 out of the cavity 30, it presses the undersides 82 of the bar 52, 56 against the opposed support shelves 80, which holds the bar 52 of the brush in the cavity at the position of furthest projection out of the cavity.

As force is applied to the bristles 54 to push them into the cavity, this pushes up on the bar 52 and the bar, in turn, deforms the spring 62, which permits the bar 52 and the bristles 54 to move into the cavity. Note the broken line positions of the spring 62 and the bar 52 in FIG. 2. As the force upon the bristles 54 is released, the spring 62 urges the bar 52 and the bristles 54 outwardly, until the end portions 56 of the bar 52 again come to rest on the shelf 80 of the retainer clip 70. Note the solid line positions of these elements in FIG. 2.

The retainer clip 70 can be easily pried out of its position in the housing cavity 30 by first pushing up on an end of the bar 52 and then pulling upon the shelf 80 until the retainer clip 70 is sufficiently deformed to free it from the projection 40. After removing the clips 70 from their projections 40, the retainers and springs 60 can be removed to permit replacement of the brush. The retainer clips 70 are then disposed over the bars 52 as previously and are simply snapped into place on the projections 40, returning the brush to use.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A nozzle with a retractable brush for the intake of a vacuum cleaner, wherein the nozzle comprises:

a nozzle housing having a bottom side and having lateral ends; a suction inlet which opens to the bottom side of the housing; the inlet having a first side with respect to motion of the nozzle housing; the first side of the inlet being defined in the housing;

a respective brush carrier in the housing and located toward each lateral end of the housing and also located outside of and at the first side of the inlet;

a brush extending along the first side of the inlet; the brush including a supporting element for being supported in the housing and including brushing means supported beneath the supporting element and projecting beneath the bottom side of the housing for brushing material before the brush as the nozzle housing is moved;

a respective integral brush spring and spring retainer for each brush carrier, and comprising:

a respective retaining means for engaging the respective brush carrier in the housing; each retaining means also being for holding the brush supporting element removably in the housing, a spring attached to and extending from the retaining means, the spring extending into contact with the brush supporting element and normally urging the brush supporting element out of the bottom side of the housing, and a shelf formed on the retaining means and projecting beneath a part of the brush supporting element for preventing the brush supporting element from moving fully out of the housing while permitting the brush supporting element to shift into the housing against the bias of the spring.

2. The nozzle of claim 1, wherein the spring also extends from the brush supporting element toward the housing, and the spring is placed and shaped to be movable against the housing as the brush supporting element is moved into the housing against the bias of the spring.

3. The nozzle of claim 1, wherein the spring and spring retainer are both of plastic.

4. The nozzle of claim 3, wherein the spring and spring retainer are an integral one piece unit.

5. The nozzle of claim 1, further comprising the nozzle housing defining a brush cavity that is located outside the inlet and at the first side of the inlet; the brush carrier, the spring and the retaining means being disposed in the brush cavity; the brush cavity having a first wall at the first side of the inlet and having a second wall which is spaced from the first wall for defining the brush cavity between the first and second walls;

the brush supporting element being of a front to back width to contact the first and second walls of the brush cavity for preventing the brush supporting element and the brush from shifting toward either of the first and second walls as the nozzle housing is moved in either of the directions toward the first and second walls.

6. The nozzle of claim 1, wherein the spring is a leaf spring, including a rounded section which extends from the retaining means and rests upon the brush supporting element, and including an extension from the rounded section of the spring, which extension is for pressing upon the housing at the interior thereof as the brush supporting element is pushed into the brush cavity.

7. The nozzle of claim 6, wherein the spring and the retaining means are an integral one piece structure.

8. The nozzle of claim 7, wherein the spring and the retaining means are both of plastic.

9. The nozzle of claim 1, wherein the brushing means comprises bristles projecting a length that with the brush supporting element resting on the shelves of both the retaining means, the bristles project a distance beneath the bottom side of the housing so that pressure applied to the bristles urge the brush and the brush supporting element into the housing against the bias of the spring.

10. The nozzle of claim 1, wherein the retaining means is removably clipped to the respective brush carrier therefor.

11. The nozzle of claim 10, wherein the brush carrier comprises a projection supported in the nozzle housing and extending toward the bottom side of the housing, and the retaining means includes a leg for engaging the projection.

12. The nozzle of claim 11, wherein the retaining means comprises a pair of legs which engage the projection along opposite sides thereof.

13. The nozzle of claim 12, further comprising the nozzle housing defining a brush cavity that is located outside the inlet and at the first side of the inlet; the brush carrier, the spring and the retaining means being disposed in the brush cavity; the brush cavity having a first wall at the first side of the inlet and having a second wall which is spaced from the first wall for defining the brush cavity between the first and second walls;

the brush supporting element being of a front to back width to contact the first and second walls of the brush cavity for preventing the brush supporting element and the brush from shifting toward either of the first and second walls as the nozzle housing is moved in either of the directions toward the first and second walls.

14. The nozzle of claim 12, wherein the shelf is attached to the legs of the respective retaining means and extends a distance from the respective legs toward the other lateral end of the housing.

15. The nozzle of claim 14, wherein the projection includes a respective second shelf thereon and the retaining means leg facing that projection has a respective surface that is seated on the shelf for latching the retaining means to the projection, and that leg of the retaining means being deformable for unlatching the retaining means from the projection.

* * * * *